US011639597B2

(12) United States Patent
Wang et al.

(10) Patent No.: US 11,639,597 B2
(45) Date of Patent: May 2, 2023

(54) MULTIFUNCTIONAL WATER OUTLET DEVICE

(71) Applicant: Xiamen Lota International Co., Ltd., Fujian (CN)

(72) Inventors: Xuedong Wang, Fujian (CN); Xiaofei Guo, Fujian (CN); Jiangcheng Zhang, Fujian (CN); Chuanbao Zhu, Fujian (CN)

(73) Assignee: Xiamen Lota International Co., Ltd., Fujian (CN)

( * ) Notice: Subject to any disclaimer, the term of this patent is extended or adjusted under 35 U.S.C. 154(b) by 72 days.

(21) Appl. No.: 16/779,814

(22) Filed: Feb. 3, 2020

(65) Prior Publication Data

US 2020/0248438 A1 Aug. 6, 2020

(30) Foreign Application Priority Data

Feb. 1, 2019 (CN) ..... 201920184313.5

(51) Int. Cl.
*E03C 1/04* (2006.01)

(52) U.S. Cl.
CPC ..... *E03C 1/0405* (2013.01)

(58) Field of Classification Search
CPC ..... E03C 1/0405; E03C 1/0404; E03B 9/20; B05B 1/1609; B05B 1/02; B05B 1/04; B05B 1/12; B05B 1/304
See application file for complete search history.

(56) References Cited

U.S. PATENT DOCUMENTS

| | | | | |
|---|---|---|---|---|
| 6,367,707 | B1 * | 4/2002 | Kang | E03C 1/04 239/447 |
| 8,424,781 | B2 * | 4/2013 | Rosko | B05B 12/002 239/449 |
| 2017/0314242 | A1 * | 11/2017 | Nogoshi | E03C 1/14 |
| 2019/0071850 | A1 * | 3/2019 | Waddell | E03C 1/0404 |
| 2019/0224694 | A1 * | 7/2019 | Wang | B05B 1/3013 |

* cited by examiner

*Primary Examiner* — Qingzhang Zhou
(74) *Attorney, Agent, or Firm* — Cooper Legal Group, LLC

(57) ABSTRACT

The present disclosure discloses a multifunctional water outlet device, comprising a first water outlet, a first waterway connecting to a water inlet of the multifunctional water outlet device and to the first water outlet, a second water outlet, a second waterway connecting to the water inlet and to the second water outlet, and a control switch configured to control opening and closing of the first waterway and the second waterway. Spray patterns of the first waterway and the second waterway are different.

16 Claims, 7 Drawing Sheets

MULTIFUNCTIONAL WATER OUTLET DEVICE

RELATED APPLICATIONS

This application claims priority to Chinese Patent Application 201920184313.5, filed on Feb. 1, 2019. Chinese Patent Application 201920184313.5 is incorporated herein by reference.

FIELD OF THE DISCLOSURE

The present disclosure relates to a faucet of bathroom fixtures, and in particular relates to a multifunctional water outlet device.

BACKGROUND OF THE DISCLOSURE

At present, water usually ejects out from an outlet of existing faucets in a horizontal direction or a downward direction. A disadvantage of the structure of the existing faucets is that when the user needs to gargle after eating, the user gargles by holding water in his or her hand or with a cup. The structure of the existing faucets is not convenient for the user when gargling.

BRIEF SUMMARY OF THE DISCLOSURE

The present disclosure provides a multifunctional water outlet device to solve deficiencies related to gargling of the existing techniques. In order to solve the aforementioned technical problems, a technical solution of the present disclosure is as follows.

A multifunctional water outlet device comprises a water inlet, a first water outlet, a first waterway connecting to the water inlet and the first water outlet, a second water outlet, a second waterway connecting to the water inlet and the second water outlet, and a control switch configured to control opening and closing of the first waterway and the second waterway. Spray patterns of water flowing from the first waterway and water flowing from the second waterway are different.

In a preferred embodiment, the second water outlet comprises a functional water member, and the water flows through the functional water member to obtain a preset spray pattern.

In a preferred embodiment, the functional water member is at least one of a mouthwash module, a spray water module, or a sheet water module.

In a preferred embodiment, the control switch drives water to eject out from the first water outlet in a horizontal direction or in a downwardly inclined direction after passing through the first waterway, or to eject out from the second water outlet in an upwardly inclined direction or upward in a vertical direction after passing through the second waterway In a preferred embodiment, an angle between the second water outlet and an axial direction of the multifunctional water outlet device ranges from 0° to 90°.

In a preferred embodiment, the first waterway and the second waterway are defined in part by a first waterway portion connected to the water inlet. The first waterway is further defined in part by a second waterway portion, and the second waterway is further defined in part by a third waterway portion. The second waterway portion connects to the first water outlet and a water outlet end of the first waterway portion. The third waterway portion connects to the second water outlet and the water outlet end of the first waterway portion. The control switch is disposed at an intersection of the water outlet end of the first waterway portion, a water inlet end of the second waterway portion, and a water inlet end of the third waterway portion.

In a preferred embodiment, the control switch comprises a water stopping assembly and a transmission assembly. The transmission assembly is configured to drive the water stopping assembly to move from the water inlet end of the third waterway portion to the water inlet end of the second waterway portion to control the first waterway to be closed and the second waterway to be open synchronously.

In a preferred embodiment, the multifunctional water outlet device comprises a body, and the transmission assembly comprises a valve body, a switching valve shaft configured to move relative to the valve body in an axial direction of the switching valve shaft, and a pressing member disposed on the body. A first end of the switching valve shaft comprises a sealing ring. The pressing member is connected to a second end of the switching valve shaft. When the pressing member moves relative to the body due to an external force, the switching valve shaft drives the sealing ring to move from the water inlet end of the third waterway portion to the water inlet end of the second waterway portion.

In a preferred embodiment, an elastic member abuts between the pressing member and the switching valve shaft.

In a preferred embodiment, the body comprises the first waterway and the second waterway. The first water outlet and the second water outlet are respectively disposed at an upper side and a lower side of the body in an axial direction, and the pressing member is disposed on the upper side, the lower side, or a front end of the body in the axial direction.

In a preferred embodiment, the multifunctional water outlet device comprises a body comprising the first waterway and the second waterway, and the control switch is an electromagnetic valve.

Compared with the background art, the technical solution has the following advantages:

The multifunctional water outlet device of the present disclosure comprises a first water outlet and a second water outlet. The water can eject out from the first water outlet in a horizontal direction or in a downwardly inclined direction, thereby enabling the user to perform regular hand washing and washing of items for use. Moreover, the water can eject out from the second water outlet upward in a vertical direction or in an upwardly inclined direction, thereby enabling the user to conveniently perform daily hygiene operations such as gargling and face washing. The second water outlet is disposed with a functional water member, so that water flows out from the second water outlet to form a mouthwash, spray water, or sheet water pattern, thereby adapting to different needs of the user, such as gargling and face washing.

The first waterway and the second waterway of the multifunctional water outlet device of the present disclosure share the water inlet, so that the structure of the multifunctional water outlet device is compact.

In a further proffered embodiment of the present disclosure, the first waterway and the second waterway share the first waterway portion connected to the water inlet, so that the structure of the multifunctional water outlet device is relatively compact. The control switch of the multifunctional water outlet device controls the second waterway to be closed while the first waterway is opened simultaneously. When the user is gargling, the water flow is configured to be concentrated in the second waterway, which ensures a height of the water flowing out from the second water outlet.

BRIEF DESCRIPTION OF THE DRAWING

The present disclosure will be further described below with the combination with the accompanying drawings and the embodiments.

DETAILED DESCRIPTION OF THE EMBODIMENTS

Embodiment 1

Figure 1:
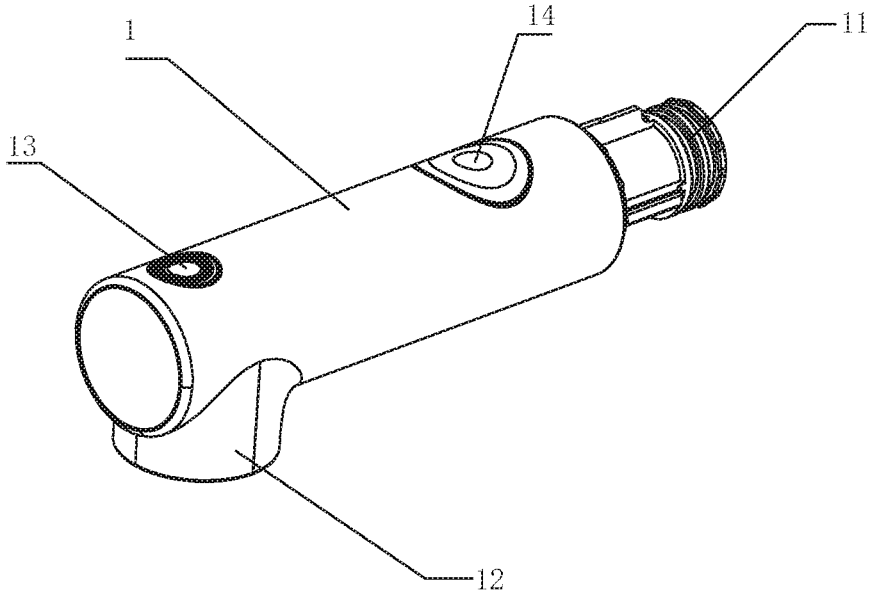
FIG. 1 illustrates a perspective view in a first view angle of Embodiment 1 of the present disclosure.
Figure 2:
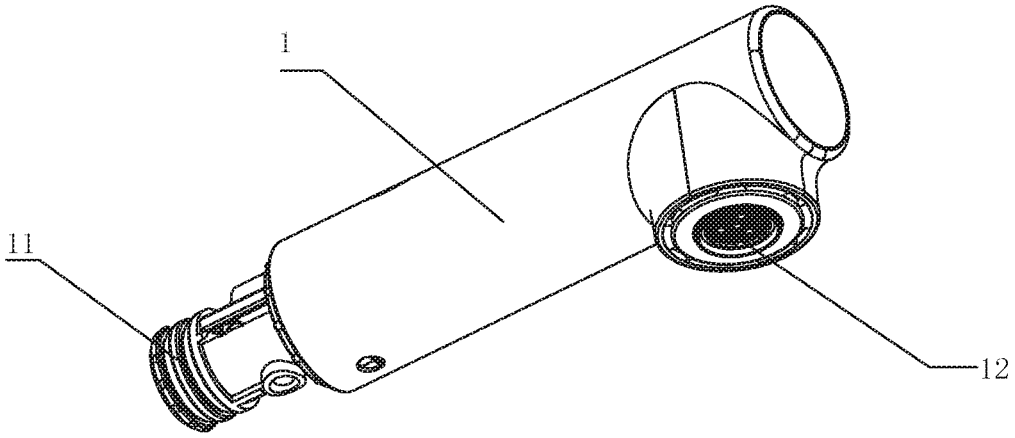
FIG. 2 illustrates a perspective view in a second view angle of Embodiment 1 of the present disclosure.
Figure 3:
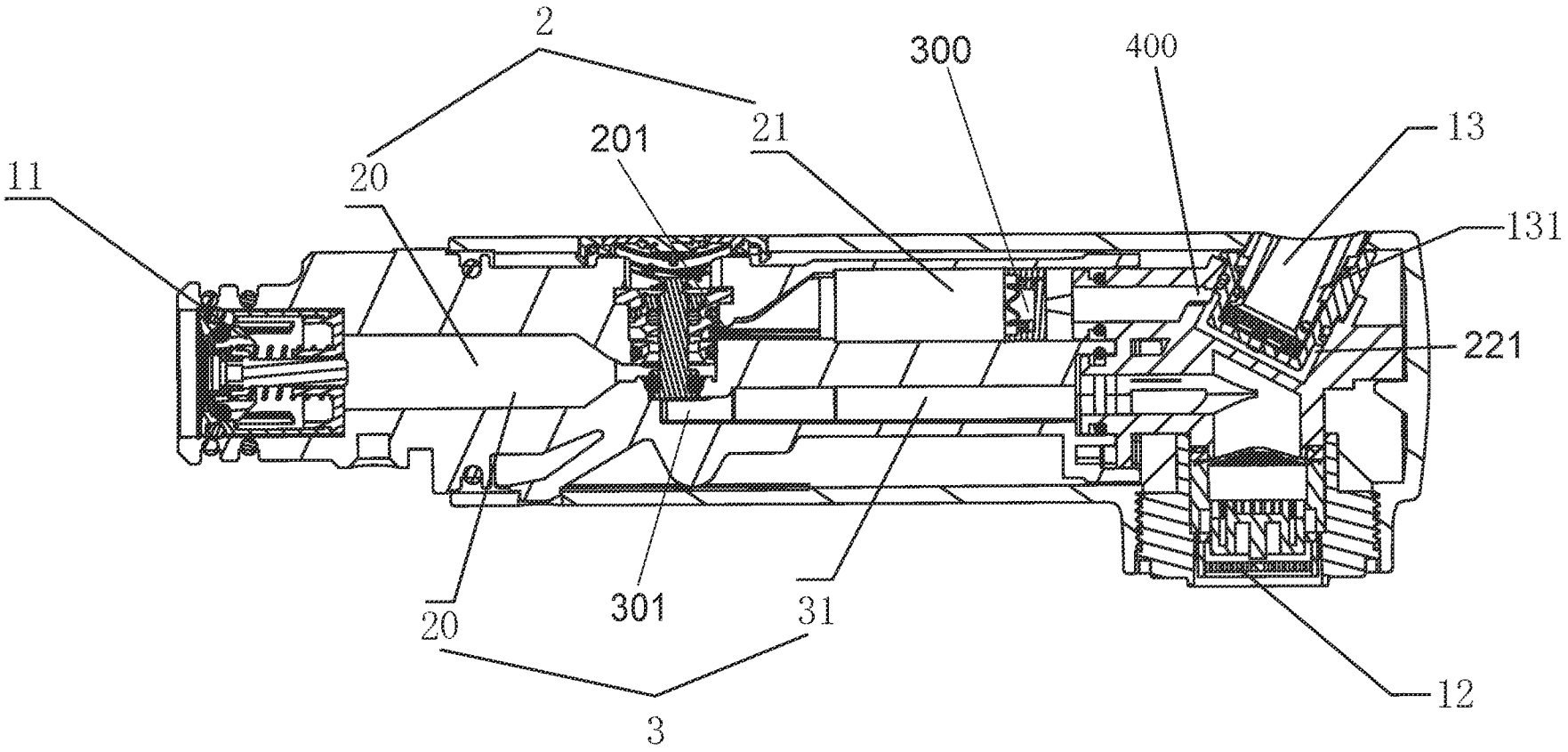
FIG. 3 illustrates a cross-sectional view of a first state of Embodiment 1 of the present disclosure in which a mouthwash module is disposed.
Figure 4:
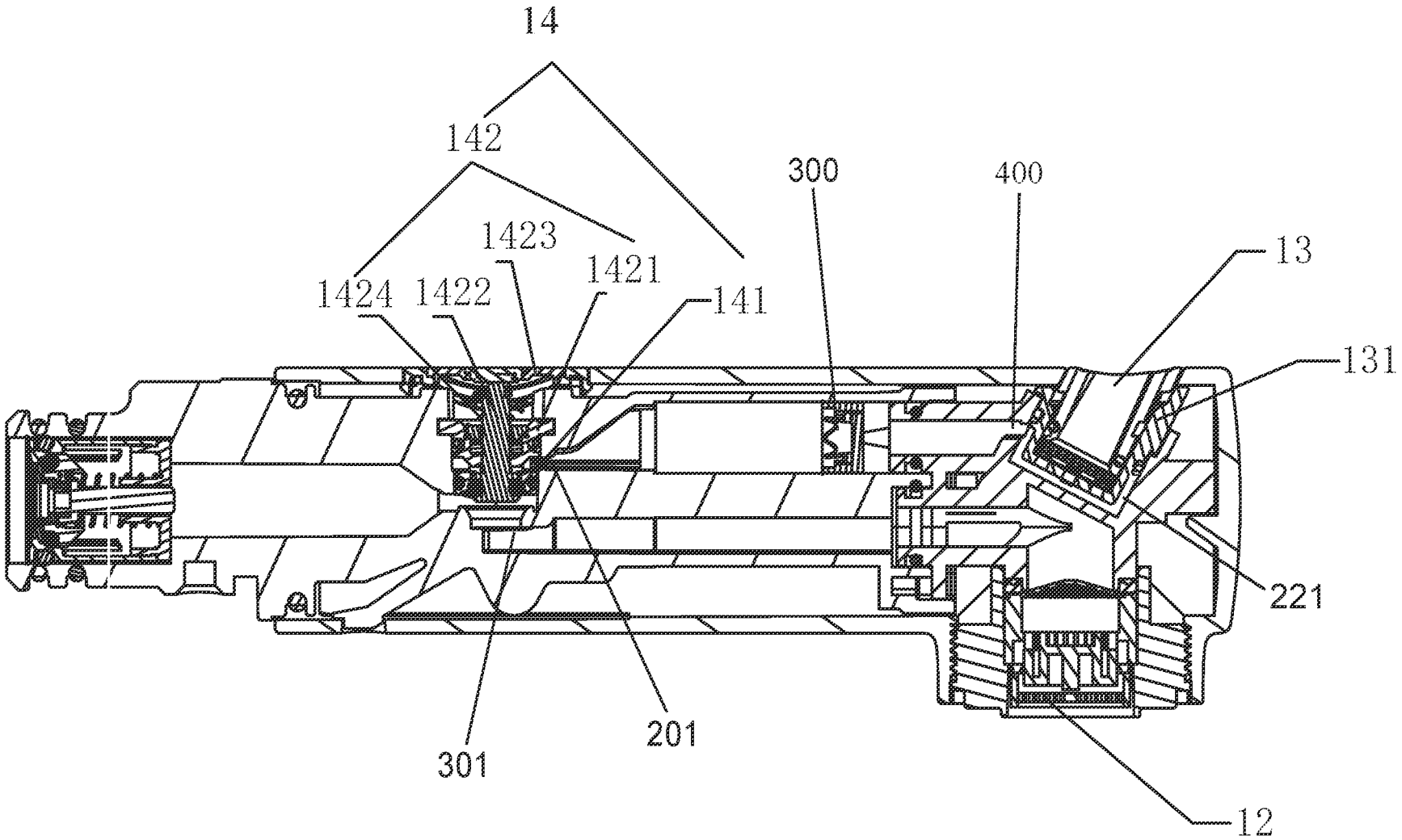
FIG. 4 illustrates a cross-sectional view of a second state of Embodiment 1 of the present disclosure in which the mouthwash module is disposed.
Figure 5:
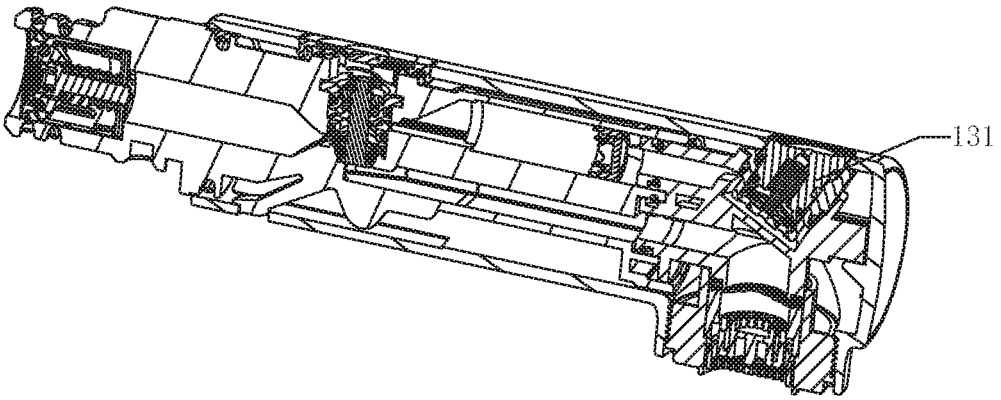
FIG. 5 illustrates a cross-sectional view of Embodiment 1 of the present disclosure in which a spray water module is disposed.
Figure 6:
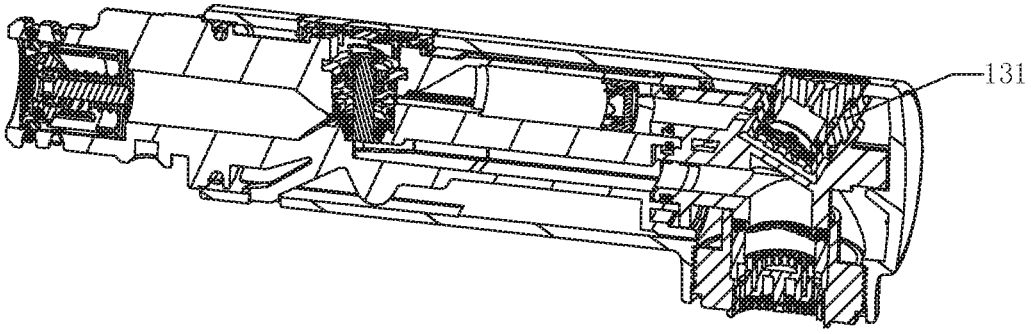
FIG. 6 illustrates a cross-sectional view of Embodiment 1 of the present disclosure in which a sheet water module is disposed.

Referring to FIGS. 1-6, a multifunctional water outlet device comprises a body 1, a first waterway 2, and a second waterway 3. The body 1 comprises a water inlet 11, a first water outlet 13, and a second water outlet 12. The first waterway 2 connects to the second water outlet 12 and the water inlet 11, and the second waterway 3 connects to the first water outlet 13 and the water inlet 11. The body 1 is further disposed with a control switch 14 configured to control opening and closing of the first waterway 2 and the second waterway 3. The second water outlet 12 and the first water outlet 13 are respectively disposed on an upper side and a lower side of the body 1 in an axial direction of the body 1.

The control switch 14 drives water from the water inlet 11 to eject out from the second water outlet 12 in a horizontal direction or in a downwardly inclined direction after passing through the first waterway 2, or eject out from the first water outlet 13 in an upwardly inclined direction or upward in a vertical direction from the water inlet 11 after passing through the second waterway 3. Spray patterns of water flowing from the first waterway 2 and water flowing from the second waterway 3 are different.

The water flowing out from the second water outlet 12 in the downward direction is suitable for washing hands and the like. The water flowing out from the first water outlet 13 in the upward direction is suitable for gargling or washing face. The aforementioned different functions require different spray patterns. Especially with respect to the first water outlet 13, the water flow needs to eject to a preset height. Therefore, the spray patterns of the second water outlet 12 and the first water outlet 13 are different. In order to obtain different spray patterns, the first water outlet 13 is disposed with a functional water member 131, and the water flows through the functional water member 131 to obtain a preset spray pattern.

As shown in FIGS. 3-6, the functional water member 131 is at least one of a mouthwash module, a spray water module, a sheet water module, etc. The mouthwash module, the spray water module, and the sheet water module are common in existing techniques. Therefore, this embodiment will not describe a shaping principle for achieving the various spray patterns and a structure of the functional water member 131 anymore. The functional water member, such as an aerator, can be disposed in the second water outlet 12 to make the water flowing out of the second water outlet 12 form a different spray pattern.

The multifunctional water outlet device comprises the second water outlet 12 and the first water outlet 13. Therefore, water ejecting out from the second water outlet 12 in a horizontal direction or a downwardly inclined direction is suitable for washing hands and the like, while water ejecting out from the first water outlet 13 in an upwardly inclined direction or upward in a vertical direction is suitable for gargling, face washing, and the like. The first water outlet 13 is disposed with the functional water member 131. In this way, the water flowing out of the first water outlet 13 forms different spray patterns, such as mouthwash water, splash water, or sheet water, and adapts to different needs of the user, such as gargling and face washing.

In this embodiment, in order to make the water flowing from the first water outlet 13 more convenient for the user to use, an angle between the first water outlet 13 and an axial direction of the multifunctional water outlet device ranges from 0° to 90°.

In order to make a structure of the multifunctional water outlet device compact, the first waterway 2 and the second waterway 3 are both defined in part by a first waterway portion 20 connected with the water inlet 11. The first waterway 2 is further defined in part by a second waterway portion 21 connected to a water outlet end of the first waterway portion 20 and the first water outlet 13, and the second waterway 3 is further defined in part by a third waterway portion 31 connected to the water outlet end of the first waterway portion 20 and the second water outlet 12. The control switch 14 is disposed at an intersection of the water outlet end of the first waterway portion 20, a water inlet end of the second waterway portion 21, and a water inlet end of the third waterway portion 31. The second waterway portion comprises a water hole 400 and a flow controller 300, and the flow controller 300 is disposed in front of the water hole 400 in a direction of flow of water. Water from the water hole 400 defines an annular water 221 between the functional water member 131 and the first water outlet 13.

In this embodiment, the control switch 14 comprises a water stopping assembly 141 and a transmission assembly 142. The transmission assembly 142 is configured to drive the water stopping assembly 141 to move from the water inlet end of the third waterway portion 31 to the water inlet end of the second waterway portion 21 to control the first waterway 2 to be closed and the second waterway 3 to be open synchronously.

Specifically, the transmission assembly 142 comprises a valve body 1421 disposed on the body 1, a switching valve shaft 1422 disposed with a sealing ring at a first end of the switching valve shaft 1422, and a pressing member 1423 disposed on the body 1. The switching valve shaft 1422 is configured to move relative to the valve body 1421 in an axial direction of the switching valve shaft 1422, and the pressing member 1423 is connected to a second end of the switching valve shaft 1422. When the pressing member 1423 moves relative to the body 1 due to an external force, the sealing ring is configured to move by the switching valve shaft 1422 from the water inlet end of the third waterway portion 31 to the water inlet end of the second waterway portion 21. The sealing ring is the water stopping assembly 141. The pressing member 1423 is a pressing button.

In order to make the pressing member 1423 automatically reset after the user stops pressing the pressing member 1423, an elastic member 1424 is disposed between the pressing member 1423 and the switching valve shaft 1422.

The pressing member 1423 is disposed on an upper side, a lower side, or a front end of an axial direction of the body 1. In this embodiment, the pressing member 1423 is disposed on the upper side of the axial direction of the body 1 for convenience.

The second waterway comprises a flow regulator 300.

A width of a first water inlet 201 of the first waterway 2 is larger than a width of a second water inlet 301 of the second waterway 3.

When the control switch 14 is in an initial position, water flows out of the first waterway 2. When the control switch 14 is switched due to an external force, water flows out of the second waterway 3. When the water is closed, the external force is released, the control switch 14 is reset to the initial position due to the elastic member 1424, and water flows out of the first waterway 2.

As a simple alternative of this embodiment, the control switch 14 can also be an electromagnetic valve.

Embodiment 2

Figure 7:
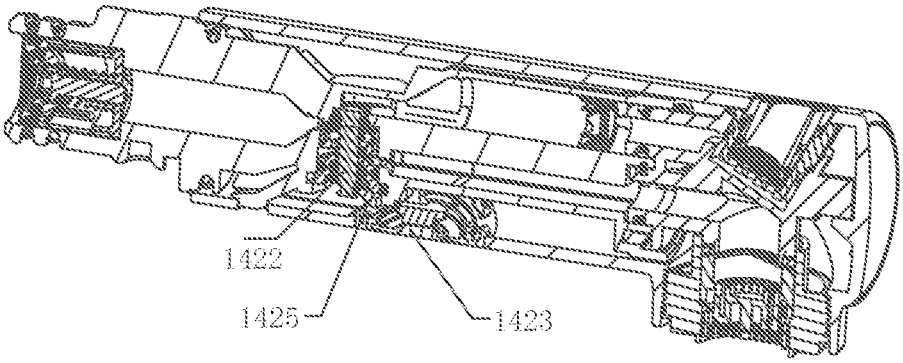
FIG. 7 illustrates a cross-sectional view of Embodiment 2 of the present disclosure in which the pressing member is disposed on a lower side of the body in an axial direction.

Referring to FIG. 7, a difference between this embodiment and the Embodiment 1 is as follows. The pressing member 1423 is disposed on the lower side of the axial direction of the body 1. Moreover, an axis of the pressing member 1423 and an axis of the switching valve shaft 1422 are not coaxial. A transmission of the pressing member 1423 and the switching valve shaft 1422 is achieved by a wedge 1425. When the pressing member 1423 is pressed down, the pressing member 1423 abuts a first end of the wedge 1425 to push the wedge 1425 to rotate, and a second end of the wedge 1425 abuts the switching valve shaft 1422, thereby pushing the switching valve shaft 1422 to be switched. The other portions in Embodiment 2 are the same as those in Embodiment 1 and will not be described here.

It will be apparent to those skilled in the art that various modifications and variations can be made in the present disclosure without departing from the spirit or scope of the invention. Thus, it is intended that the present disclosure cover the modifications and variations of this invention provided they come within the scope of the appended claims and their equivalents.

What is claimed is:

1. A multifunctional water outlet device, comprising:

a water inlet, a first water outlet, a first waterway connecting to the water inlet and the first water outlet, a second water outlet, a second waterway connecting to the water inlet and the second water outlet, a body, and a control switch configured to control opening and closing of the first waterway and the second waterway, wherein:

the first waterway and the second waterway are defined in part by a first waterway portion connected to the water inlet, the first waterway is further defined in part by a second waterway portion, the second waterway is further defined in part by a third waterway portion, the second waterway portion connects to the first water outlet and a water outlet end of the first waterway portion, the third waterway portion connects to the second water outlet and the water outlet end of the first waterway portion, the first water outlet comprises a functional water member, the second waterway portion comprises a water hole and a flow controller, the flow controller is disposed in front of the water hole in a direction of flow of water, water from the water hole defines an annular water between the functional water member and the first water outlet, the control switch is disposed at an intersection of the water outlet end of the first waterway portion, a water inlet end of the second waterway portion, and a water inlet end of the third waterway portion, the second water outlet is disposed at a lower side of the body in an axial direction of the body, the first water outlet is disposed at an upper side of the body in the axial direction of the body, a first spray pattern of the water flowing from the first waterway is different from a second spray pattern of water flowing from the second waterway, the first waterway portion becomes narrower in the direction of flow of the water, when the control switch is in an initial position due to an elastic member, the water flows out of the second water outlet in a horizontal direction or in a downwardly inclined direction, when the control switch is switched:

the elastic member is compressed, and the water flows out of the first water outlet in an upwardly inclined direction or upward, and when the water is shut off, the control switch is reset to the initial position due to the elastic member, and the water flows out of the second water outlet.

2. The multifunctional water outlet device according to claim 1, wherein:

the water flows through the functional water member to obtain a preset spray pattern.

3. The multifunctional water outlet device according to claim 2, wherein the functional water member is at least one of a mouthwash module, a spray water module, or a sheet water module.

4. The multifunctional water outlet device according to claim 1, wherein an angle between the first water outlet and the axial direction of the body ranges from 0° to 90°.

5. The multifunctional water outlet device according to claim 1, wherein:

the control switch comprises a water stopping assembly and a transmission assembly, and the transmission assembly is configured to drive the water stopping assembly to move from the water inlet end of the third waterway portion to the water inlet end of the second waterway portion to control the second waterway to be closed and the first waterway to be open synchronously.

6. The multifunctional water outlet device according to claim 5, wherein:

the transmission assembly comprises a valve body, a switching valve shaft configured to move relative to the valve body in an axial direction of the switching valve shaft, and a pressing member disposed on the body, a first end of the switching valve shaft comprises a sealing ring, the pressing member is connected to a second end of the switching valve shaft, and when pressing member moves relative to the body due to an external force:

the switching valve shaft drives the sealing ring to move from a first position for opening the water inlet end of the third waterway portion to a second position for opening the water inlet end of the second waterway portion.

7. The multifunctional water outlet device according to claim 6, wherein the elastic member abuts between the pressing member and the switching valve shaft.

8. The multifunctional water outlet device according to claim 7, wherein:

the body comprises the first waterway and the second waterway, and the pressing member is disposed on the upper side, the lower side, or a front end of the body in the axial direction of the body.

9. The multifunctional water outlet device according to claim 1, wherein:

the body comprises the first waterway and the second waterway, and the control switch is an electromagnetic valve.

10. The multifunctional water outlet device according to claim 1, wherein the second waterway comprises a flow regulator.

11. The multifunctional water outlet device according to claim 1, wherein a width of the water inlet end of the second waterway portion is smaller than a width of the water inlet end of the third waterway portion.

12. The multifunctional water outlet device according to claim 6, wherein:

an axis of the pressing member and an axis of the switching valve shaft are not coaxial, a transmission of the pressing member and the switching valve shaft is achieved by a wedge, and when the pressing member is pressed:

the pressing member abuts a first end of the wedge to push the wedge to rotate, and a second end of the wedge abuts the switching valve shaft, thereby pushing the switching valve shaft to be switched.

13. The multifunctional water outlet device according to claim 1, wherein:

the second waterway portion is tapered to become narrower in a direction opposite to flow of the water.

14. The multifunctional water outlet device according to claim 1, wherein:

the water hole becomes wider in a direction opposite to flow of the water.

15. The multifunctional water outlet device according to claim 1, wherein:

a width of the water outlet end of the first waterway portion is larger than a width of the water inlet end of the second waterway portion.

16. A multifunctional water outlet device, comprising:

a water inlet, a first water outlet, a first waterway connecting to the water inlet and the first water outlet, a second water outlet, a second waterway connecting to the water inlet and the second water outlet, a body, and a control switch configured to control opening and closing of the first waterway and the second waterway, wherein:

the first waterway and the second waterway are defined in part by a first waterway portion connected to the water inlet, the first waterway is further defined in part by a second waterway portion, the second waterway is further defined in part by a third waterway portion, the second waterway portion connects to the first water outlet and a water outlet end of the first waterway portion, the third waterway portion connects to the second water outlet and the water outlet end of the first waterway portion, the first water outlet comprises a functional water member, the second waterway portion comprises a water hole and a flow controller, the flow controller is disposed in front of the water hole in a direction of flow of water, water from the water hole defines an annular water between the functional water member and the first water outlet, the control switch is disposed at an intersection of the water outlet end of the first waterway portion, a water inlet end of the second waterway portion, and a water inlet end of the third waterway portion, the second water outlet is disposed at a lower side of the body in an axial direction of the body, the first water outlet is disposed at an upper side of the body in the axial direction of the body, a first spray pattern of the water flowing from the first waterway is different from a second spray pattern of water flowing from the second waterway, the control switch comprises a water stopping assembly and a transmission assembly, the transmission assembly is configured to drive the water stopping assembly to move from the water inlet end of the third waterway portion to the water inlet end of the second waterway portion to control the second waterway to be closed and the first waterway to be open synchronously, the transmission assembly comprises a valve body, a switching valve shaft configured to move relative to the valve body in an axial direction of the switching valve shaft, and a pressing member disposed on the body, a first end of the switching valve shaft comprises a sealing ring, the pressing member is connected to a second end of the switching valve shaft, an axis of the pressing member and an axis of the switching valve shaft are not coaxial, a transmission of the pressing member and the switching valve shaft is achieved by a wedge, when the control switch is in an initial position due to an elastic member, the water flows out of the second water outlet in a horizontal direction or in a downwardly inclined direction, when the control switch is switched:

the elastic member is compressed, and the water flows out of the first water outlet in an upwardly inclined direction or upward, when the water is shut off, the control switch is reset to the initial position due to the elastic member, and the water flows out of the second water outlet, when the pressing member is pressed:

the pressing member abuts a first end of the wedge to push the wedge to rotate, and a second end of the wedge abuts the switching valve shaft, thereby pushing the switching valve shaft to be switched, and when pressing member moves relative to the body due to an external force:

the switching valve shaft drives the sealing ring to move from a first position for opening the water inlet end of the third waterway portion to a second position for opening the water inlet end of the second waterway portion.

* * * * *